US005605280A

United States Patent [19]

Hartman

[11] Patent Number: 5,605,280

[45] Date of Patent: Feb. 25, 1997

[54] SELF-BALANCING VARIABLE AIR VOLUME HEATING AND COOLING SYSTEM

[76] Inventor: Thomas B. Hartman, 9905 39th Drive Northeast, Marysville, Wash. 98270-9116

[21] Appl. No.: 650,621

[22] Filed: May 20, 1996

Related U.S. Application Data

[62] Division of Ser. No. 532,969, Sep. 22, 1995, Pat. No. 5,535,814.

[51] Int. Cl.[6] ..... F24F 3/044

[52] U.S. Cl. ..... 236/49.3; 165/209; 165/217

[58] Field of Search ..... 236/1 B, 49.3; 165/209, 217

[56] References Cited

U.S. PATENT DOCUMENTS

| | | | |
|---|---|---|---|
| 4,318,508 | 3/1982 | Glasgow et al. | 236/47 |
| 4,505,426 | 3/1985 | Rossi et al. | 236/47 |
| 4,545,524 | 10/1985 | Zelczer | 165/22 X |
| 4,630,221 | 12/1986 | Heckenback et al. | 364/505 |
| 4,646,964 | 3/1987 | Parker et al. | 236/49 |
| 4,718,021 | 1/1988 | Timblin | 165/22 X |
| 4,723,593 | 2/1988 | Kuribayashi | 165/11.1 |
| 4,942,921 | 7/1990 | Haessig et al. | 165/16 |
| 5,005,636 | 4/1991 | Haessig | 165/16 |
| 5,117,900 | 6/1992 | Cox | 165/53 |
| 5,179,524 | 1/1993 | Parker et al. | 165/22 X |
| 5,251,814 | 10/1993 | Warashina et al. | 236/49.3 |
| 5,251,815 | 10/1993 | Foye | 236/49.3 |
| 5,271,558 | 12/1993 | Hampton | 236/49.3 |
| 5,275,333 | 1/1994 | Tamblyn | 236/51 |
| 5,279,458 | 1/1994 | DeWolf et al. | 236/47 |
| 5,289,094 | 2/1994 | Young | 318/468 |
| 5,303,767 | 4/1994 | Riley | 165/12 |
| 5,318,224 | 6/1994 | Darby et al. | 236/47 |
| 5,325,286 | 6/1994 | Weng et al. | 364/141 |
| 5,341,988 | 8/1994 | Rein et al. | 236/49.3 |
| 5,344,069 | 9/1994 | Marikiyo | 165/22 X |
| 5,360,374 | 11/1994 | Wyon et al. | 454/306 |
| 5,361,985 | 11/1994 | Rein et al. | 236/49.3 |

*Primary Examiner*—William E. Tapolcai
*Attorney, Agent, or Firm*—Marger, Johnson, McCollom & Stolowitz, P.C.

[57] ABSTRACT

A variable air volume heating and cooling system that provides automatic system-wide airflow balancing is disclosed. To balance the system, each terminal box maximum airflow setting is automatically and continuously adjusted in response to central supply fan loading conditions together with local zone conditions. The new system has the advantage of automating both initial air balancing of terminal units at the time of installation, as well as rebalancing to respond to changing conditions, without technician intervention. Substantial savings in energy cost can be achieved since the operating curve of each terminal unit is automatically adjusted to demand no more conditioned air volume than necessary.

8 Claims, 6 Drawing Sheets

SELF-BALANCING VARIABLE AIR VOLUME HEATING AND COOLING SYSTEM

This is a division of application Ser. No. 08/532,969, filed Sep. 22, 1995, now U.S. Pat. No. 5,535,814.

FIELD OF THE INVENTION

This invention pertains to the field of variable air volume heating and/or cooling systems employed in heating and/or cooling of buildings or portions of buildings. More specifically, the present invention is directed to methods and apparatus for improving efficiency of heating/cooling systems, and increasing user comfort, while reducing or eliminating the need for expensive manual "balancing" of such systems.

BACKGROUND OF THE INVENTION

Variable air volume HVAC systems employ a central fan (or "primary supply") system and multiple "terminal units" (also referred to as a "box" or "terminal box") which maintain proper zone conditions by adjusting the amount of airflow to each zone in order to maintain a space temperature setpoint. One example of such a prior art system is disclosed in U.S. Pat. No. 5,005,636 incorporated herein by this reference.

Typically, a variable air volume central fall system comprises a central fan with some means of varying the flow of air from the central fan to the ductwork that supplies air to a network of terminal boxes. Each terminal box regulates the quantity of airflow in an attempt to meet current local space conditions as measured by a local zone temperature sensor. (For simplicity, tiffs discussion assumes that each zone has a single corresponding terminal box.) It is known to use a computer-based or other digital controller to operate each terminal box, and the adjustment of airflow in response to sensed temperature change is the subject of existing patents such as U.S. Pat. Nos. 5,325,286; 5,303,767; and 4,646,964.

Variable volume air systems have been employed for heating and air conditioning in commercial buildings for about twenty-five years. They are currently the system of choice by the industry, and widely employed in office and institutional buildings. In a variable air volume system, one or more central air supply fans are sized to meet the anticipated peak cooling (and/or heating) requirements for the building. Each individual terminal box is sized to meet expected peak conditions of the space (or zone) it serves, which may or may not coincide with building peak conditions.

Each terminal box in a variable air volume system is provided with a preset box maximum airflow level. The box reacts to meet the loads on the space as determined by a space temperature sensor and provides airflow to cool (or heat) the space as needed, but only up to that preset maximum airflow. No further airflow will be delivered no matter how much further the space temperature varies from setpoint conditions. This box maximum airflow level is applied to ensure a reasonable balance of airflow is available to all boxes at all times, even when some zones may be experiencing severe or unusual loads. Adjustment of the terminal box maximum airflow levels is known in trade as "balancing" the I-IVAC system. In general, each terminal unit operates "open loop" in that the overall load on the primary air supply is unknown and is ignored. As a result, each terminal unit attempts to "take" whatever conditioned airflow volume it deems necessary, and some units may be "starved" if the system is not properly balanced.

Considerable time and effort is required to balance known variable air volume systems at the time of their installation. A trained installer collects airflow and temperature measurement data in each zone, and then attempts to set a respective maximum airflow level for each terminal box such that all boxes have a reasonable airflow level available at all times. Obviously, this procedure represents a compromise in allocating a limited resource, and may not be optimal. User complaints may require another attempt at balancing the system. Moreover, manufacturers recommend rebalancing every few years as the loads in each zone change, for example due to rearrangement of seating and furniture and/or changes in window coverings. Rebalancing therefore is expensive and even if it is well done changing conditions can require it to be done periodically. It is known that a digital network can be employed to adjust terminal dampers in response to one or more zones experiencing air starvation. See U.S. Pat. No. 5,341,988. However, there is no known existing technology that provides automatic system-wide airflow balancing in which box maximum airflow settings are adjusted in response to the central fan conditions as well as local zone conditions. Nor does the prior art teach how to avoid initial air balancing of terminal units at the time of installation. A need remains therefore to reduce the frequency and cost of rebalancing a variable air volume system. Moreover, the need remains to improve the accuracy of balancing such a system so as to maximize user comfort and operating economy.

Another requirement in a variable air volume system is to maintain at least a selected minimum outside air ventilation airflow to each zone whenever the zone is occupied. In some systems, each terminal unit is connected to at least two ducts—a conditioned air duct and an outside air (or "ventilation") duct. In such systems, each terminal unit determines an appropriate mix of conditioned air together with outside air, based on zone temperature setpoints. Automatic rebalancing must take into account minimum ventilation requirements.

SUMMARY OF THE INVENTION

Accordingly, one principal object of the present invention is to provide automatic balancing of both single and dual duct variable air volume systems upon their installation.

Another object of the invention is to automatically rebalance such a system as needed without manual intervention.

A further object is to continuously rebalance a VAV system over time such that neither initial nor scheduled rebalance efforts are required. Accomplishment of these objects will result in improved user comfort and reduced operating costs.

One aspect of the invention is a variable air volume system for heating and/or cooling of a multiple-zone space that automatically rebalance airflow as needed.

Another aspect of the invention is a VAV terminal unit that operates in response to loading on the primary air supply system.

A further object is to save energy in connection with heating and/or cooling a building space using a VAV system.

In the preferred embodiment, a computer-based or other controller is deployed at each terminal unit. The individual terminal unit controllers are coupled via a communications link to the primary air supply system. Each terminal unit automatically establishes and continuously adjusts its own airflow limits as heating and cooling conditions change, taking into account the primary supply system load as indicated over the communications link. Since each terminal unit derives its current airflow setpoint frown the box maximum (and minimum) airflow levels, adjustment of the box maximum airflow level modifies operation of the terminal unit at all temperatures where conditioned airflow is required.

According to the invention, space temperature requirements are maintained as follows. When each terminal unit is started, the unit controller has a factory preset or default box maximum airflow level that is generally determined by the physical box size. This initial box maximum airflow level is automatically adjusted under the following circumstances. Anytime the box is operating at the current box maximum airflow level but not satisfying the space temperature requirement of the space, and after the expiration of a selected time delay (for example 0–60 minutes), the box maximum airflow level will begin to slowly reset upwards if either the box damper is less than 100% open or the primary supply is operating at less than a selected percentage of its maximum flow capacity (called the "threshold load"). An indication of the primary supply operating load, e.g. a percentage of maximum airflow, is sent to all terminal units served by the fan over the communications link.

If the terminal unit has operated for a substantial period of time, e.g. more than one full day, without requiring the current box maximum airflow volume to satisfy space conditions, and if the primary supply system is operating at more than the threshold load, then the box maximum airflow will gradually reset downward as long as current space temperature is within setpoint and the box is operating above the box minimum airflow established for ventilation. Optionally, airflow limits may be installed for each box by the operator to prevent the automatic balancing operation from exceeding a selected maximum airflow level at which noise or drafts may become objectionable to the zone occupant(s).

According to another aspect of the invention, minimum airflow requirements are satisfied as follows. Whenever the zone supplied by a box is occupied and operating, the amount of outside air required is calculated from a preset number of occupants that the operator establishes in the box controller. A separate controller that is controlling the primary supply fan continuously calculates the percentage of outside air in the supply air stream. An indication of the percent of outside air in the supply air stream is transmitted to all boxes served by the primary supply over the communications link. Each box uses this value and the minimum required outside air ventilation airflow to calculate the minimum airflow to the box so long as the zone remains occupied.

The foregoing and other objects, features and advantages of the invention will become more readily apparent from the following detailed description of a preferred embodiment which proceeds with reference to the drawings.

DETAILED DESCRIPTION OF A PREFERRED EMBODIMENT

1. Prior Art

Figure 1:
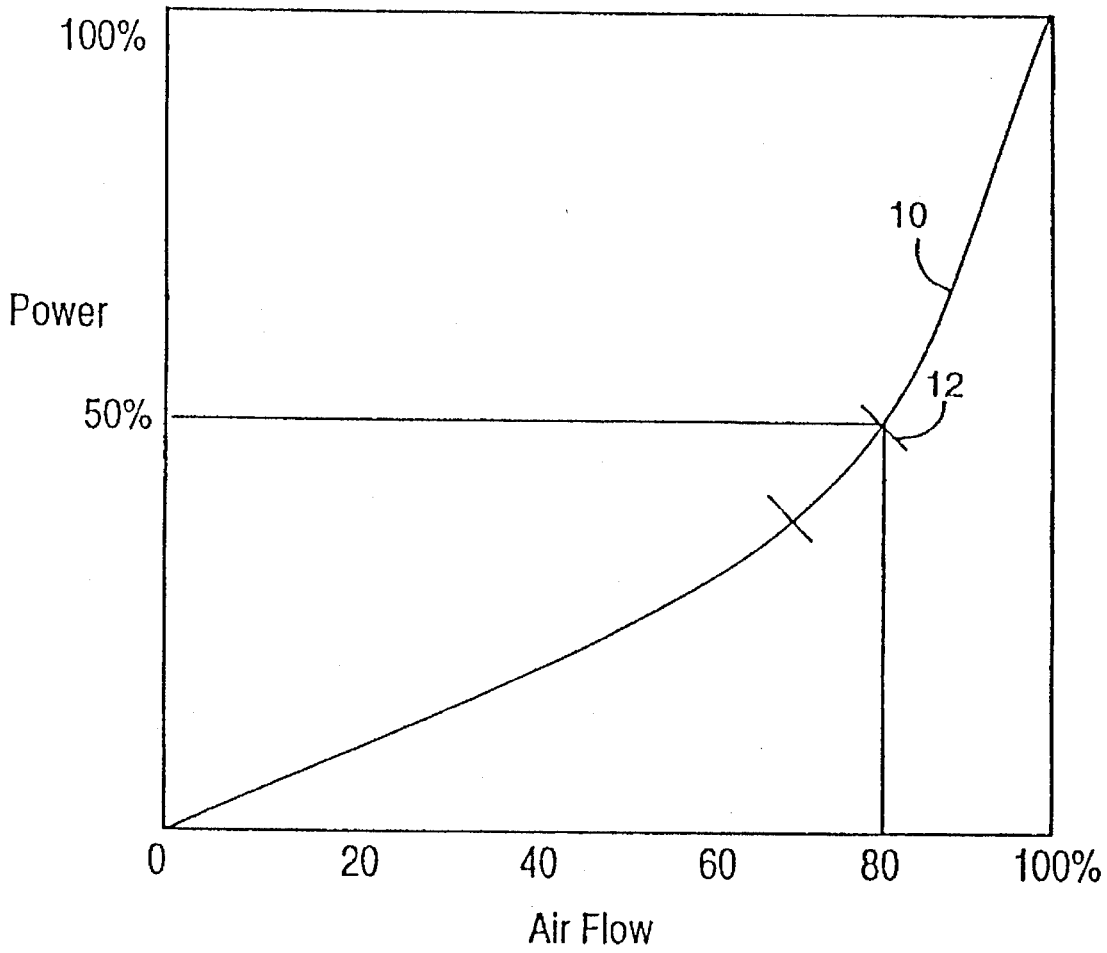
Fig. 1 (Prior Art)
FIG. 1 is a graph illustrating power versus airflow for a typical variable airflow primary supply utilizing variable speed air flow control.

FIG. 1 (prior art) illustrates applied power versus air flow (curve 10), for a typical primary airflow supply in a building or a floor of a building. Curve 10 includes a preferred operating region or "sweet spot" 12 roughly delineated in the drawing by a pair of line segments crossing the curve. In the operating region 12, a majority of total or possible airflow, say 75–80%, is provided for a relatively modest amount of applied power, say 40–50%. Accordingly, it represents a desirable operating region in terms of efficiency. Conversely, efficiency declines more rapidly as the operating point is pushed up toward maximum airflow and applied power. One object of the present invention is to maintain an efficient supply system operating point without sacrificing occupant comfort, as further explained later.

Figure 2:
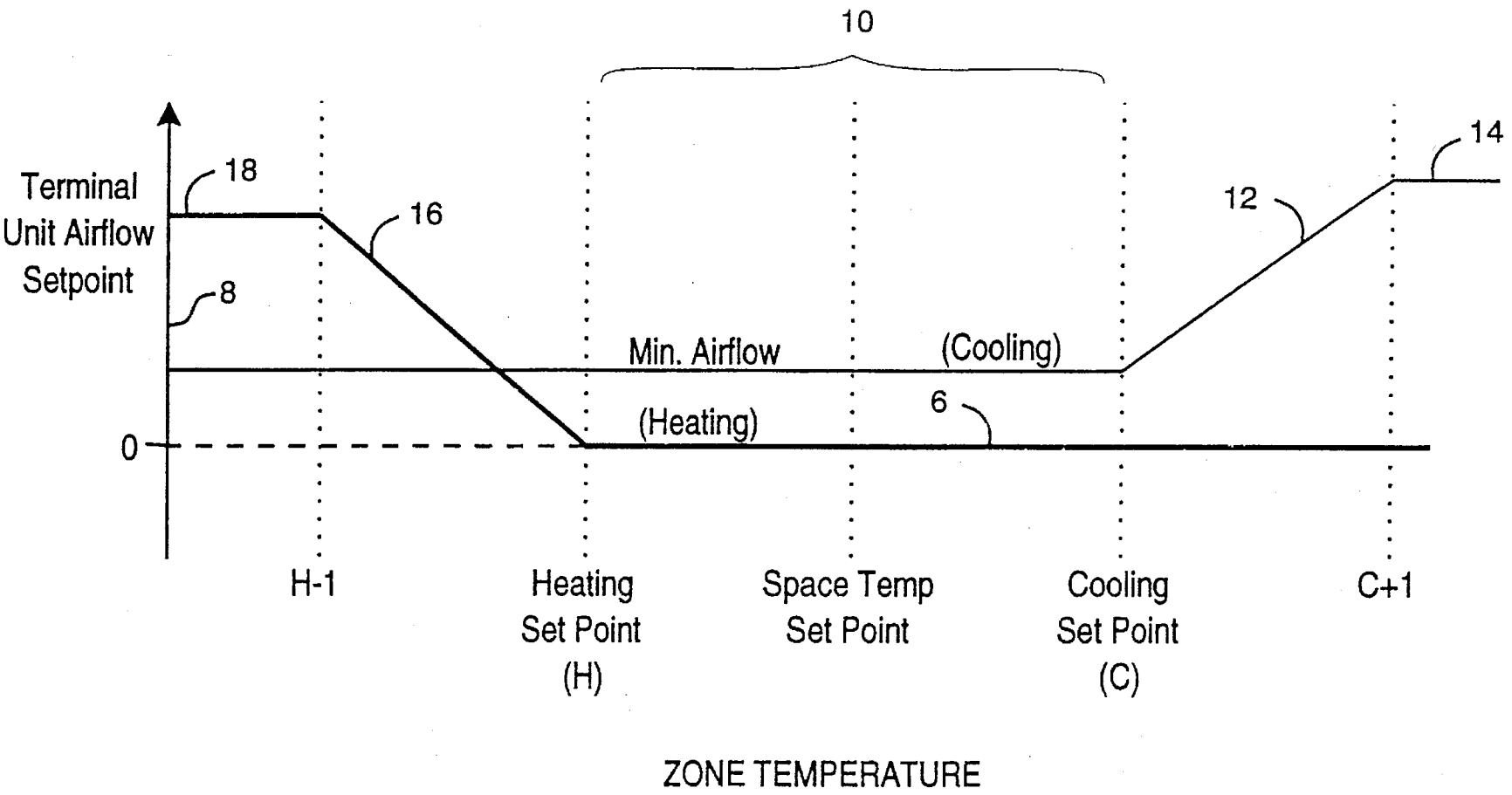
Fig. 2 (Prior Art)
FIG. 2 is a graph illustrating airflow setpoint vs. zone temperature in a prior art variable air volume HVAC system terminal unit.

FIG. 2 (prior art) is a graph representing airflow setpoint versus zone temperature in a known HVAC system terminal unit. By "airflow setpoint" we mean an airflow volume level which the terminal unit will attempt to maintain. The "space temp [temperature] set point" shown on the horizontal (zone temperature) axis is a desired space temperature as set by a user, for example at a thermostat. It is manually set at a desired temperature, for example 68 degrees F. "Zone" is used here to refer to an individual office or an area of a building in which heating, cooling and ventilation requirements are provided by a corresponding terminal unit.

The terminal unit controller determines a "cooling set point" (C) defined as a predetermined increment, for example 1 degree F., above the space temperature set point. The unit also assumes as a "heating set point" (11) a predetermined temperature increment, again perhaps 1degree F., below the space temperature set point. Accordingly, there is a "dead band" indicated by bracket 10 between the heating and cooling set points, which is typically on the order of 2 degrees F and generally is symmetrically centered about the space temperature set point. Heated airflow setpoint is zero in the deadband, while cooling airflow is at a minimum level selected for ventilation as noted above. The terminal unit is not otherwise "activated" until the corresponding zone temperature either exceeds the cooling set point (in which case additional cooling is needed), or falls below the heating set point (in which case heating is needed). The dead band in between the two set points provides economy and stability. Some mechanism for hysteresis may be provided at each of the H and C set points to avoid oscillation of heating or cooling equipment.

In operation, when the zone temperature exceeds the cooling set point C, cooling airflow into the zone is gradually increased, generally in direct proportion to the temperature, as indicated by line 12 in FIG. 2. The cooling airflow increases with temperatures up to a predetermined maximum cooling airflow limit indicated by line 14, and it remains at that level despite any further increase in temperature. In the example illustrated, the maximum cooling airflow is reached at temperature C+1. Similarly, when the zone temperature falls below the heating set point H, heated airflow is gradually increased in inverse proportion to the temperature as indicated by line 16, again up to a predetermined maximum heating airflow limit indicated at 18. As indicated in the background discussion, terminal units in the prior art operate independently of each other. Thus, in the typical prior art system, a plurality of zones are served by a common primary air supply. Each zone has an independent terminal unit that operates as described with reference to FIG. 2. Each zone thus uses increased airflow from the primary supply whenever its local zone temperature is outside its local setpoints. There is no attempt to coordinate operation among multiple units, except to the extent that manual "balancing" helps to properly distribute primary airflow resources as described in the Background section.

2. New Self-Balancing System General Arrangement

Figure 3:
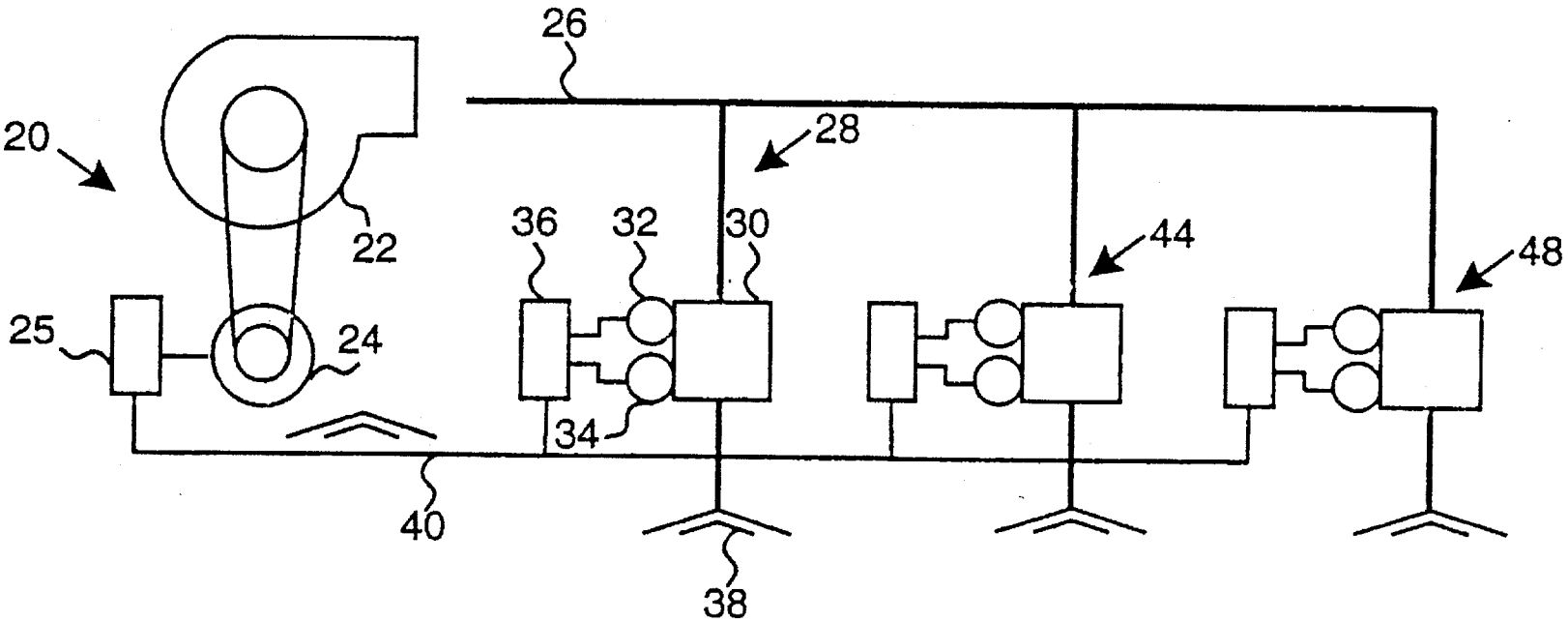
FIG. 3 is an electro-mechanical schematic diagram illustrating one embodiment of the invention in a self-balancing variable air volume system.

Referring next to FIG. 3, an electro-mechanical schematic diagram illustrates one embodiment of the invention in a self-balancing variable air volume system. FIG. 3 shows a primary air supply system 20 comprising a fan 22 driven by a motor 24 so as to provide a primary air supply to a duct 26. Several, in this example three, variable air volume terminal units, indicated generally as 28,44 and 48 are coupled to the duct 26 to receive the primary air supply. Each of the terminal units is located in a respective zone of a building, for example, and each terminal unit draws upon the primary air supply system so as to provide a controlled airflow supply into the corresponding zone to meet local heating and cooling requirements as further explained below.

Multiple fans and/or motors (not shown) may be incorporated in the primary air supply system 20. The primary air supply system 20 also includes an electronic control device ("primary controller") 25 such as a microprocessor-based controller which among other functions regulates the volume and pressure of air discharged into the duct 26, for example by varying the speed of the motor 24. The fan controller 25 and each of the terminal units are interconnected by a communications link 40 described below. It is not essential, however, that the terminal units communicate directly among one another. Accordingly, the communication link 40 could assume, for example, a star configuration with the primary supply at the hub, rather than the linear arrangement illustrated.

The various terminal units may be located in individual offices or they might be in an open area or slave units or any combination. Each terminal unit, e.g. unit 28, comprises a motorized flow regulating device usually called an air damper 34, and a flow measuring device 32, both of which are monitored and controlled by a local electronic control device 36 called a terminal unit controller (not to be confused with the single primary controller 25), such as a microprocessor-based controller. Each VAV terminal unit provides a regulated, conditioned air stream into the local zone through a corresponding air diffuser 38. Under normal circumstances, the amount of air delivered is regulated in response to a space temperature sensor (not shown) which is also connected to the terminal unit controller (e.g. 36) at each box.

Regulation of the primary air volume and pressure in FIG. 3 is based on conditions at the terminal units served. For example, if the air flow setpoints of all terminal units are satisfied with all the flow regulating devices (dampers) less than fully open (as reported by the terminal unit controller), then the primary air volume and pressure is slowly reduced. On the other hand, if at least one terminal unit reportedly is delivering less than its air flow setpoint with the flow regulation device full open, then the primary air volume and pressure is slowly increased. This primary air volume and pressure regulation technique is called terminal regulated air volume (TRAV) and is prior art. The terminal unit conditions may be communicated from the terminal unit controllers to the primary supply controller over a communication link 40.

Communications link 40 is provided between the primary air supply controller and each of the terminal unit controllers to implement primary air supply regulation and automatic air-balancing of the system. The communications link can be implemented in various ways, including without limitation wired or wireless, analog or digital, or a hybrid arrangement. As will be shown, the data communications bandwidth requirements are quite modest. The communications link may even be implemented without any "dedicated" channel at all, e.g. using signals superimposed on the A.C. power line, assuming due regard to filtering motor electrical "noise".

3. Operation of the Terminal Unit

A. In General

Figure 4:
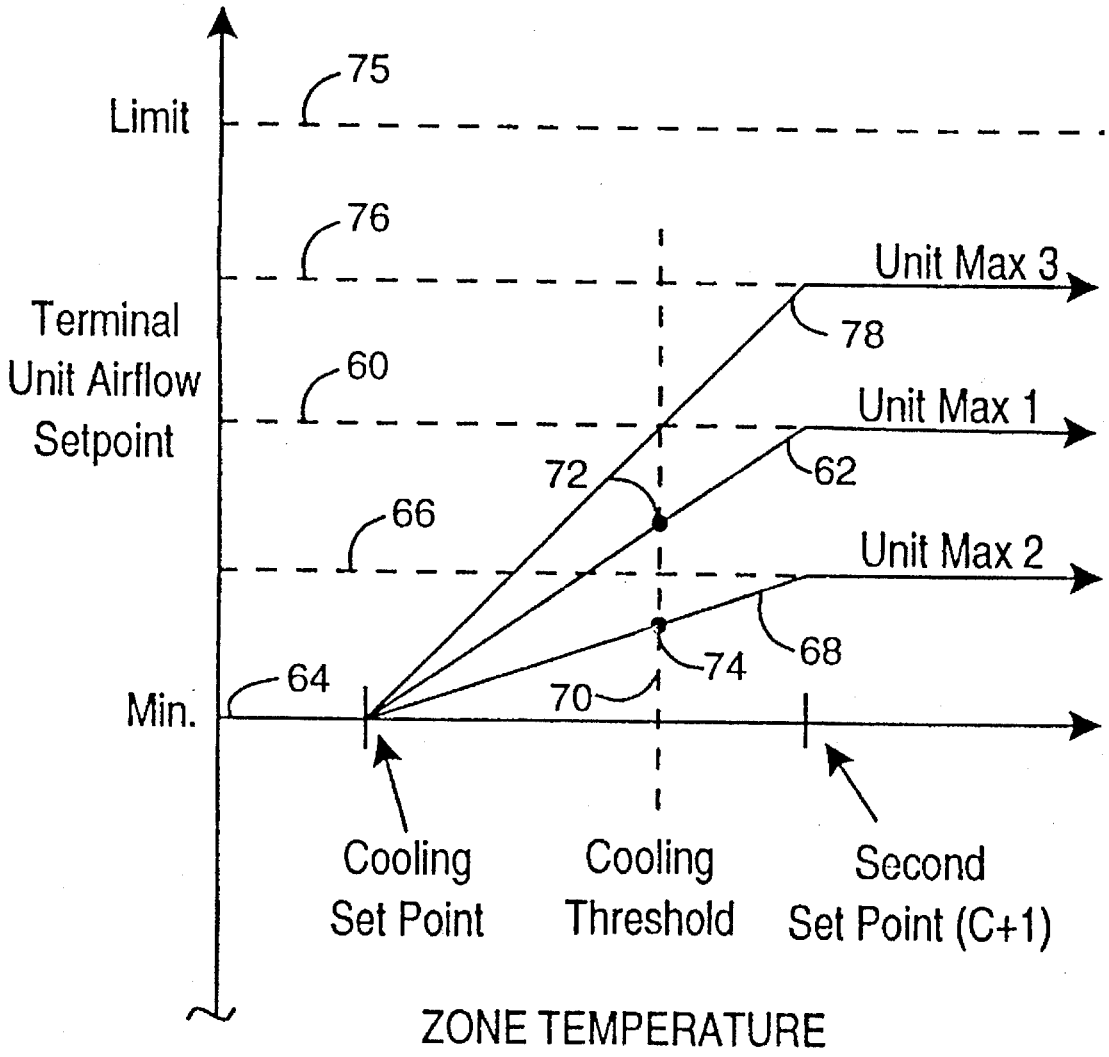
FIG. 4 is a graph illustrating operation of a terminal unit according to the present invention.

FIG. 4 illustrates cooling operation of each of the individual terminal units, e.g. unit 28, in the new system. In FIG. 4, the vertical axis represents the individual terminal unit airflow setpoint (which could be expressed, e.g. in CFM or a percentage of a maximum airflow, the latter being used here for illustration). The horizontal axis represents zone temperature, i.e. the temperature detected by a local temperature sensor disposed within the corresponding zone and coupled to the local zone box controller. Zone temperature increases to the right in the drawing. This graph illustrates a region of operation generally between the cooling set point (C) on the left and a second, higher set point (nominally cooling set point +1 degree) on the right, each indicated by a corresponding tick mark on the horizontal axis.

A new "Cooling Threshold" temperature is indicated by dashed line 70. The Cooling Threshold is determined by the terminal unit controller as a predetermined increment above the cooling temperature setpoint. Preferably, it is between C and C+1. The Cooling Threshold is selected to ensure a reasonably comfortable temperature for the user(s) of the corresponding zone. It need not necessarily be the same in every zone. The automatic balancing methodology explained herein is constrained so as to reduce airflow only in zones operating below the corresponding cooling threshold temperature, regardless of the load level on the primary supply fan, as further explained later.

A. Default Maximum Airflow Operation

Dashed line 60 indicates a default or nominal maximum airflow level for this particular unit. The default maximum airflow may be set at the factory. A first operating curve 62 is formed by linear interpolation between the cooling set point (C) and the second set point (C+1) at the nominal maximum airflow level 60. Curve 62 need not necessarily be a straight line, although linear interpolation simplifies the airflow setpoint calculations in the terminal unit controller. In general, the unit airflow increases along curve 62 as zone temperature increases above the cooling set point. At zone temperatures above the second set point temperature (e.g. C+1 degree), the unit simply operates at the maximum airflow level 60—labeled "Unit Max 1" in the figure. Below the cooling set point, no cooling is required although a selected minimum airflow for ventilation may be provided. Thus, the horizontal axis does not necessarily intersect at zero airflow setpoint on the vertical axis. Rather, a horizontal region 64 of the operating curve 62 may represent a minimum airflow level for ventilation independent of zone temperature. For example, industry standards call for importing at least 20 CFM of outside air for each person in the zone.

B. Reduced Maximum Airflow Operation

FIG. 4 also illustrates an example of reduced maximum airflow level indicated by dashed line 66. A linear interpolation from the cooling set point to the reduced maximum airflow at the second set point is shown by curve 68. Thus curve 68 illustrates an alternative operating characteristic curve in which the terminal unit airflow still varies in direct proportion to the local zone temperature, but the whole curve is reduced relative to the default curve 62. As a result, less airflow is used in the operating region intermediate the cooling setpoint and the second setpoint. At zone temperatures above C+1, the unit simply operates at the reduced maximum airflow volume—labeled "Unit Max 2" in the figure. The same concept is equally applicable to the heating operation. A "reduced maximum" heating airflow level can be effected in the same manner to reduce airflow demand between the heating set point and the second setpoint, H-$\partial$ where $\partial$ is a predetermined increment such as one degree F.

C. Increased Maximum Airflow.. Operation

FIG. 4 further illustrates an operating curve 78, determined by linear interpolation between the cooling setpoint and another maximum airflow level 76 at set point C+1. This "Unit Max 3" airflow level is greater than the default level 60. As before, the new maximum airflow level changes the entire operating curve above the cooling setpoint, because the terminal unit controller calculates its current airflow setpoint based upon the zone temperature and the current maximum airflow level. In general, the maximum airflow level can be varied automatically, as explained below, to any level—from a level near zero, or a predetermined ventilation minimum, up to the box absolute maximum—the greatest airflow volume it is capable of sustaining. As explained, varying the maximum airflow level changes the operating curve for the affected unit at all zone temperatures.

4. Adjusting the Unit Maximum Airflow Level

A. Monitoring Primary Airflow Supply (Fan) Loading

Adjustment of each local terminal unit airflow maximum level is dependent upon current loading on the primary air supply, i.e. the total demand imposed on the primary air supply by all of the functioning terminal units, as well as current zone conditions and setpoints. The primary air supply load level can be determined in the primary air supply system (e.g. by the primary controller) by monitoring air volume and/or pressure, or by monitoring fan speed, using techniques that are known. There are also known techniques for monitoring primary supply motor current, RPM and the like to determine the primary supply system loading. An indication of the primary supply load level is communicated by the primary controller to all of the terminal units via the communication link 40 in FIG. 3. The indication of the primary load level may take the form, for example, of a percentage of capacity (digitally encoded or represented by an analog voltage level), or perhaps a binary indication (high load, low load—indicating, respectively, load levels above and below the "threshold load" further explained below). This information is used to modify the airflow maximum levels in each terminal unit as described next.

This modification may be a continuous function, e.g. proportional to the supply system loading, or the maximum airflow level may assume two or more discrete levels. Continuous modification of the terminal unit operations in proportion to the primary supply load is preferred. For simplicity, three examples of different operating curves 68, 62, 78 are shown in FIG. 4, corresponding to three discrete maximum airflow levels 66, 60 and 76 respectively. Each maximum airflow level defines a corresponding operating curve (airflow setpoint versus zone temperature).

B. Automatically Increasing the Maximum Airflow Level

At start-up, each variable air volume terminal unit is initialized at a default maximum airflow level that is proportional to nominal box size, and a default minimum airflow. The initial minimum airflow is based on a continuously calculated percentage of outside air in the supply air stream and an operator entered number of zone occupants, so as to ensure at least a predetermined minimum outside air mix for ventilation. Each terminal unit then regulates airflow into the corresponding zone between these maximum and minimum values in response to the locally sensed temperature. The exact amount of airflow supplied to the zone at various conditions depends on the value of these limits as noted.

Assume an individual terminal unit supplies air to zone 1 and is operating at the unit maximum airflow limit, and the space temperature of zone 1 is well above the space temperature setpoint. Then, after the expiration of a predetermined time delay, the zone 1 unit controller (36 in FIG. 3) will check to see if the airflow modulating damper (34) is fully open. If it is not, then the unit maximum airflow level will be increased, e.g. at a rate of approximately 0.5% per minute, until the damper is fully open or the space temperature falls within the setpoint range (i.e. less than C+1 in FIG. 2).

Next, if the terminal unit airflow modulating damper is fully open, then the unit controller checks the primary supply lead level. If this value is less than a predetermined level, e.g. approximately 75% of maximum capacity, then the unit maximum airflow will be gradually increased. For example, it may be increased at a rate of approximately 0.1% per minute until the primary supply fan lead percentage increases to more than 75% or the local zone temperature falls within the setpoint range.

Figure 5:
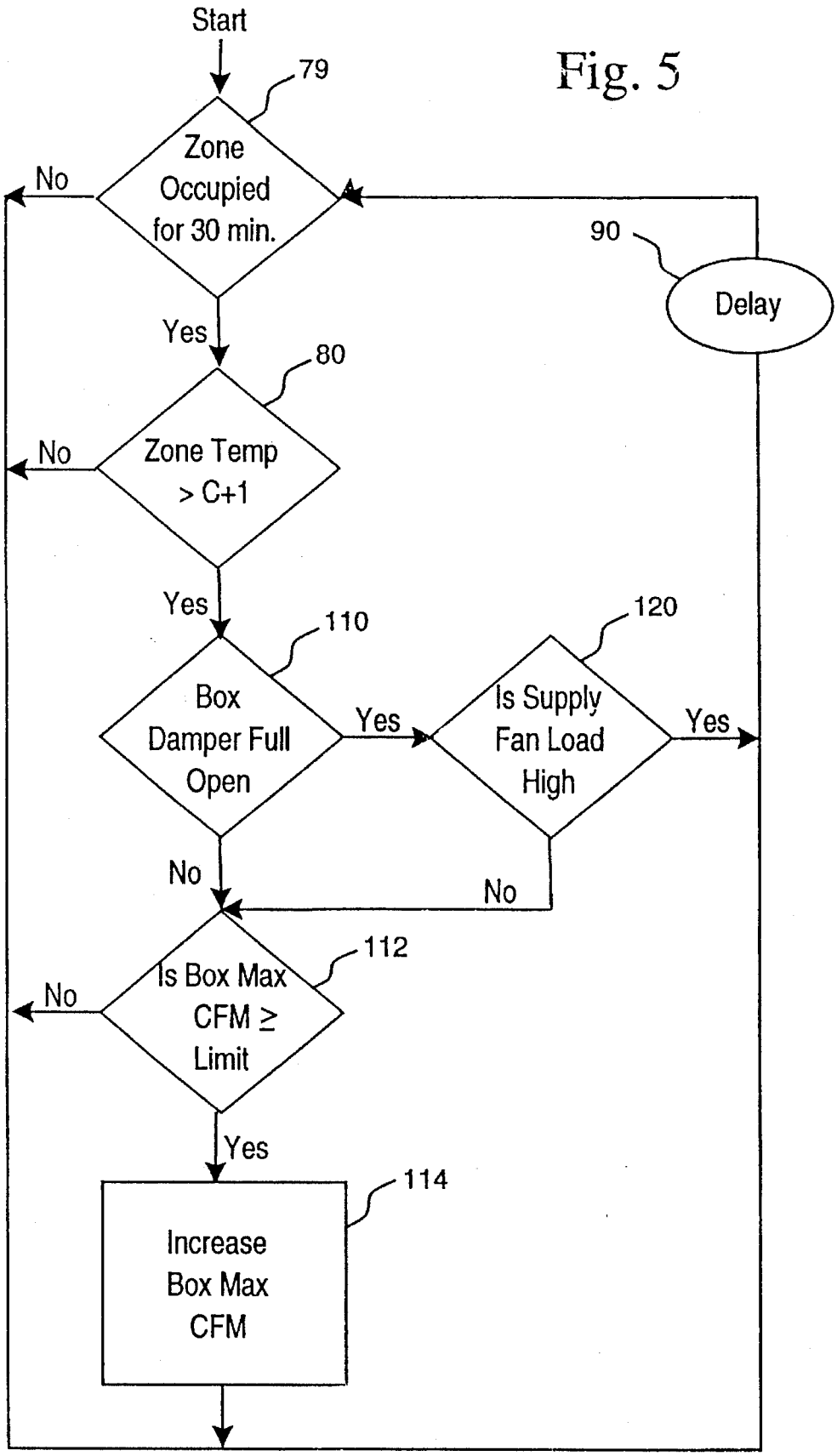
FIG. 5 is a flow diagram illustrating operation of a terminal unit according to the present invention to provide automatic increase of the unit airflow maximum level.

FIG. 5 illustrates the foregoing process in a control flow diagram. Referring to FIG. 5, if the zone has been occupied for some time, typically about 30 minutes, so that it has had a chance for conditions to stabilize (test 79), and if the zone temperature (test 80) determines that the zone temperature is beyond the C+1 limit (the space is overheated, and the airflow setpoint is at its current maximum), test 110 determines whether or not the unit damper is full open, and if not, the unit maximum airflow limit is incremented (step 114) so long as it is not at or above an operator established limit (test 112). Such an optional limit may be imposed when noise or drafts in the zone are an overriding issue. This limit is indicated by dashed line 75 in FIG. 4. In this way, blocks 79, 80, 110, 112, 114 and 90 together form a loop that will gradually increase the unit maximum airflow level as long as the zone temperature remains outside the requirements and the damper is not fully opened. In this regard, the unit self-balances itself without regard to the supply fan load.

If 110 determines that the damper is fully opened, control passes to check the primary supply load in test 120. This is done by checking load information communicated to the terminal units from the primary air supply controller via the communications link (40 in FIG. 3) as described above. If that load level is high, in other words the primary supply is already working hard, control proceeds to delay 90 and back around the control loop just described. Conversely, if the primary supply is not heavily loaded, then the local terminal unit airflow maximum level may be increased. Again, another test 112 may be employed to ensure that the current box maximum level is at or below a limit set by the user.

An analogous methodology is useful where the system is supplying heating through a hot duct arrangement. Thus, where the damper is fully open, and the primary supply load is less than say 75% of maximum capacity, the terminal unit maximum airflow will be gradually increased until the supply airflow increases to a predetermined level or the local zone temperature increases to within the heating set point range.

C. Automatically Lowering of the Maximum Airflow Level

Next, we define a "Cooling Threshold" temperature as a predetermined increment, e.g. between zero and one degree, above the cooling setpoint. In FIG. 4, the cooling threshold is indicated by dashed line 70. It is selected to ensure user comfort, by maintaining the present maximum airflow setting (and hence maintaining the current operating curve) whenever the zone temperature is above the cooling threshold. Below that temperature, the zone is reasonably comfortable (although it may be above the cooling setpoint), so the maximum airflow level can be reduced somewhat to improve distribution of air to zones experiencing high loads and to improve economy.

However, it is unnecessary to lower the curve if the central fan is operating at an efficient load level. Accordingly, the zone box controller checks the primary supply fan load level. As noted previously, an indication of the in load level is continuously or periodically transmitted from the primary in controller via the communication link 40 to the terminal units. If this value is greater than a predetermined value within a range of approximately 60% to 75%, it implies reduced efficiency of the primary supply system (central fan). This loading level at the primary supply system is called the "threshold load". If the current load level exceeds the threshold load, and the space temperature is below the cooling threshold, then the local box maximum airflow will be decreased, e.g. at a rate of approximately 0.1% per minute, until the primary supply load level decreases to a more efficient operating point, e.g. less than 75%, or the space temperature rises above the cooling threshold. A similar reaction would take place if the system were supplying heating through a hot duct arrangement.

For example, assume a given terminal unit is operating on curve 62 of FIG. 4, implying the current maximum airflow level is at dashed line 60. If the airflow maximum is lowered to level 66, then operation changes to curve 68. Specifically, if the operating point was at point 72 on curve 62, then the new operating point will be point 74 on curve 68. This illustrates the greatest change in airflow because, as noted, the operating characteristic curve is not changed in those units operating at a local temperature above the cooling threshold 70. For lower temperatures (between the cooling set point and the cooling threshold temperature), the amount of airflow reduction is less, as shown in the drawing. Near the cooling set point, the cooling airflow required is minimal anyway and the change is nearly zero. The result of these changes is to reduce demand on the primary supply system where greater airflow is unnecessary for comfort anyway. The changes are effected in each terminal unit by the corresponding controller in response to the primary load information indicated via the communications link as further explained below. In short, when the primary fan is working hard, then all of the individual terminal units that are not working hard are going to reduce their maximum airflow volume.

At the same time, other terminal units may be operating at full capacity. For example, where the local zone temperature exceeds the second set point, maximum airflow is provided through the terminal units. The above described automatic reduction in airflow (by reducing the airflow maximum level under appropriate circumstances) in those terminal units where it is appropriate makes increased airflow available to other terminal units where it is needed. This has the effect of balancing the system. Preferably, this automatic balancing adjustment is made gradually over time.

Additionally, each individual terminal unit can adjust its own airflow maximum as appropriate, depending on zone conditions. For example, if a given unit is operating down near the cooling set point in the summer, it is probably located in a small room where relatively little airflow is required. In that case, one might reduce the maximum airflow relatively quickly. That might be, for example, a reduction of 20 CFM per hour. Conversely, in a zone operating closer to (but still below) the cooling threshold temperature, one might just very gradually reduce that maximum airflow, e.g. 2 CFM per hour. Thus, the rate of change of maximum airflow level can be determined by each terminal unit controller as a function of local temperature. This improves stability and results in very accurate, continuous rebalancing of the system without a technician service call. Improvements in efficiency may allow a smaller capacity, less expensive primary air supply system.

Figure 6:
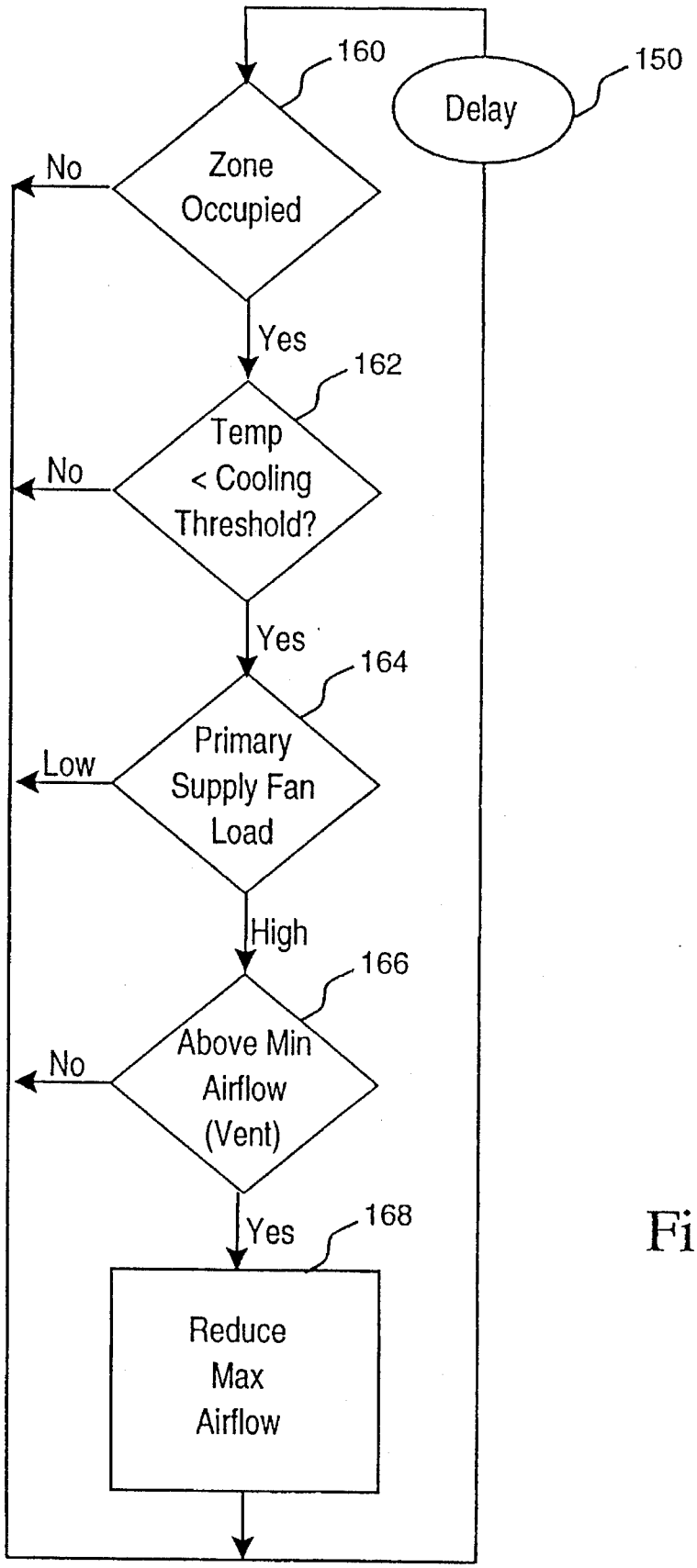
FIG. 6 is a flow diagram illustrating operation of a terminal unit according to the present invention to provide automatic decrease of the unit airflow maximum level.

FIG. 6 illustrates the foregoing method for automatically reducing the maximum airflow limit in those terminal units where less airflow is required. In FIG. 6, test 160 determines whether the zone is presently occupied, e.g. using input from an occupancy detector. If occupied, the zone temperature is checked in step 162 to see if it is less than the cooling threshold temperature. If so, the primary supply fan load level is checked in test 164 as described above. If the load level exceeds the threshold load ("high"), the local airflow setpoint is compared in test 166 to the minimum airflow level required for ventilation. If airflow exceeds that minimum (i.e. it is at least adequate), then the maximum airflow level is reduced in step 168, e.g. by a predetermined decrement amount. Then, after a delay period 150, the process is repeated, so as to continuously adjust the maximum airflow level.

The operations illustrated in FIGS. 5 and 6 preferably are implemented in software, for example in a program arranged for execution by a microcontroller disposed in each terminal unit. Delay timers can be implemented using an interrupt scheme. The use of interrupt driven procedures may be preferable depending upon the features of the microprocessor selected for a given application. Details will be apparent to those of ordinary skill in microcontroller applications.

The communications link 40 call also serve to communicate information from each of the terminal units back to the supply fall controller. Specifically, each terminal unit transmits an indication to the supply controller when it reaches 100% damper open condition and may also transmit information indicating an amount by which its current actual airflow falls short of its current airflow setpoint. In response, the supply fall controller is able to increase the primary supply airflow.

It should be noted that while the described methodology can be applied to virtually any VAV system, the greatest precision will be realized if an occupancy sensor is incorporated into each zone controller such that adjustment takes place only under occupied conditions. Where occupancy sensors are deployed, each occupied terminal unit minimum airflow limit is continuously calculated based upon the percent of outside air in the air stream from the primary supply air fan, and all operator entered number of occupants in the zone.

Another advantage of this invention is that it obviates initial manual balancing of a central heating and/or cooling system. The terminal units can all be identically preset at the factory to some typical values of maximum and minimum airflows, and then they will automatically, over time, reconfigure themselves to optimize performance for the particular installation as described above.

Having illustrated and described the principles of my invention in a preferred embodiment thereof, it should be readily apparent to those skilled in the art that the invention can be modified in arrangement and detail without departing from such principles. In particular, but without limitation, allocation of functions between hardware and software is subject to wide variation depending upon numerous design considerations for any particular application. The principles disclosed herein can be implemented in many different combinations of hardware and software, as a matter of design choices, without departing from the principles of the invention. I claim all modifications coming within the spirit and scope of the accompanying claims.

I claim:

1. In a VAV terminal unit coupled to a primary air supply and having a damper to control terminal unit airflow, the terminal unit also having a predetermiend unit maximum airflow, a method of operation comprising the steps of:

monitoring a local zone temperature; and if the local zone temperature is outside predetermined zone requirements and the damper is not fully open, incrementally increasign the unit maximum airflow level.

2. A method according to claim 1 further comprising:

in the terminal unit, monitoring an indication of a current load level of the primary air supply; and if the local zone temperature is outside the zone requirements, and the damper is fully open, incrementally increasing the unit maximum airflow level only if the indicated primary air supply load level is below a predetermined supply load threshold.

3. A method according to claim 2 wherein said increasing the terminal unit airflow maximum includes increasing the terminal unit airflow maximum at a selected rate of approximately 0.5% per minute.

4. A method according to claim 2 wherein said increasing the terminal unit airflow maximum includes increasing the terminal unit airflow maximum at a selected rate in a range of approximately 2 to 20 CFM per hour.

5. A method according to claim 1 further comprising:

monitoring a time elapsed since the zone become occupied;

in the terminal unit, monitoring an indication of a current load level of the primary air supply; and if the local zone temperature is outside requirements and the damper is fully open, incrementally increasing the unit maximum airflow but only if the supply load is below a predetermined supply load threshold.

6. In a VAV terminal unit coupled to a primary air supply and having a damper to control terminal unit airflow, the terminal unit also having a predetermined terminal unit maximum airflow, a method of operation comprising the steps of:

monitoring a local zone temperature;

monitoring a local terminal unit airflow setpoint;

determining whether the local zone temperature has remained continuously within predetermined zone requirements for at least a predetermined time interval;

determining whether the terminal unit airflow setpoint has continuously remained below the current unit maximum airflow for at least the predetermined time interval, incrementally decreasing the terminal unit maximum airflow, thereby adjusting the operation of the terminal unit so as to reduce load on the primary air supply.

7. A method according to claim 6 further comprising comparing the current unit airflow maximum to a predetermined minimum airflow level, and incrementally decreasing the unit maximum airflow only if the current airflow maximum is above the minimum airflow level.

8. A method according to claim 6 further comprising:

monitoring a primary supply system load; and incrementally decreasing the unit maximum airflow limit only if the primary supply system load is greater than a predetermined primary load threshold.

* * * * *